United States Patent [19]

Baker et al.

[11] 4,151,882

[45] May 1, 1979

[54] ANCHORING AND FIRE EXTINGUISHING SYSTEM

[76] Inventors: Francis E. Baker, 465 Fox River Dr., Bloomfield Hills, Mich. 48013; James H. Davidson, R.R. 31, Box 330, Terre Haute, Ind. 47803

[21] Appl. No.: 817,188

[22] Filed: Jul. 20, 1977

[51] Int. Cl.[2] ..... A62C 35/12

[52] U.S. Cl. ..... 169/62; 169/9

[58] Field of Search ..... 52/2, 168, DIG. 11; 169/62, 54, 9; 239/200, 207, 208, 209

[56] References Cited

U.S. PATENT DOCUMENTS

| | | | |
|---|---|---|---|
| 2,804,929 | 9/1957 | Plummer | 169/62 X |
| 3,993,139 | 11/1976 | Vaughn | 169/62 |

FOREIGN PATENT DOCUMENTS

| | | | |
|---|---|---|---|
| 838446 | 4/1970 | Canada | 52/2 |

*Primary Examiner*—John J. Love

*Attorney, Agent, or Firm*—Basile and Weintraub

[57] ABSTRACT

An anchoring and fire extinguishing system for mobile homes and the like comprising a water filled container that has a shape which is complementary to the peripheral outer edge of the mobile home, such that the mobile home may be positioned on top of the filled water container and supported thereby. The interior of the water filled container is provided with a pressurizing means operable to maintain the pressure of the water at a sufficient level such that water may be communicated through suitable conduits to a plurality of sprinkling heads disposed within the interior of the mobile home to extinguish a fire therein.

5 Claims, 5 Drawing Figures

ANCHORING AND FIRE EXTINGUISHING SYSTEM

BACKGROUND OF THE INVENTION

I. Field of the Invention

The present invention relates to fire extinguishing and, more particularly, to a system for automatically releasing and directing a charge of fire extinguishing agent, such as water, onto a fire that may be within a mobile home and wherein the system functions to anchor the mobile home in a desired location.

II. Description of the Prior Art

Due to the ever increasing expense of modern-day home construction, the use of mobile homes has become a widely used alternative to the conventional home. Due to the construction of the modern-day mobile home, that is, the type of materials used to construct the mobile home and their limited access, the mobile home may burn rapidly trapping individuals therein in the event of a fire. It would therefore be desirable to provide a fire extinguishing system for such mobile homes which is operable to rapidly extinguish internal fires in such mobile homes and one which is operable in response to a predetermined level of heat within the mobile home without having to depend on the outside sources of power, such as electrical energy or the like, for the purpose of providing an adequate water supply.

To the knowledge of the inventor, no known system has been provided which will provide a fire extinguishing system for mobile homes or the like. Extinguishing systems are known for a variety uses; and U.S. Pat. No. 2,530,001 and U.S. Pat. No. 3,040,815 both disclose various types of fire extinguishing systems of which applicant is aware. The fire extinguishing device disclosed in U.S. Pat. No. 2,530,001 is relevant in that it relates to a pressurized system for deploying water onto a fire within a building. U.S. Pat. No. 3,040,815 is relevant in that it discloses a fire extinguishing apparatus having a plastic bag formed of sheets of polyethylene and containing a fire extinguishing agent.

III. Prior Art Statement

In the opinion of the applicant, the above-mentioned prior art represents the closest prior art of which the applicant is aware.

SUMMARY OF THE INVENTION

The present invention, which will be described subsequently in greater detail, comprises an anchoring and fire extinguishing system for mobile units and the like. The system comprises a water filled container having a peripheral shape following the contour of the mobile unit and is adapted to receive and support the unit in a stationary position. Fastening means are provided for connecting the container to the mobile unit so as to secure the unit to the container. Conduit means are provided for communicating the water filled interior of the container to a plurality of sprinkling heads disposed inside the interior of the unit. Means for pressurizing the interior of the water filled container are provided so as to force water under pressure through the conduit means and the sprinkling heads to extinguish any fire which may occur in the unit.

It is therefore a primary object of the present invention to provide a new and improved fire extinguishing system for mobile units, such as a mobile home or the like.

It is a further object of the present invention to provide such a fire extinguishing system which is independently operable, having its own water and pressure supply, such that it may operate independent of public utilities in any desired location.

It is still a further object of the present invention to provide a fire extinguishing system of the type described which functions to anchor a mobile unit in a desired location so as to prevent the mobile unit from being tipped over during severe weather.

Other objects, advantages and applications of the present invention will become apparent to those skilled in the art of fire extinguishing systems for mobile units when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
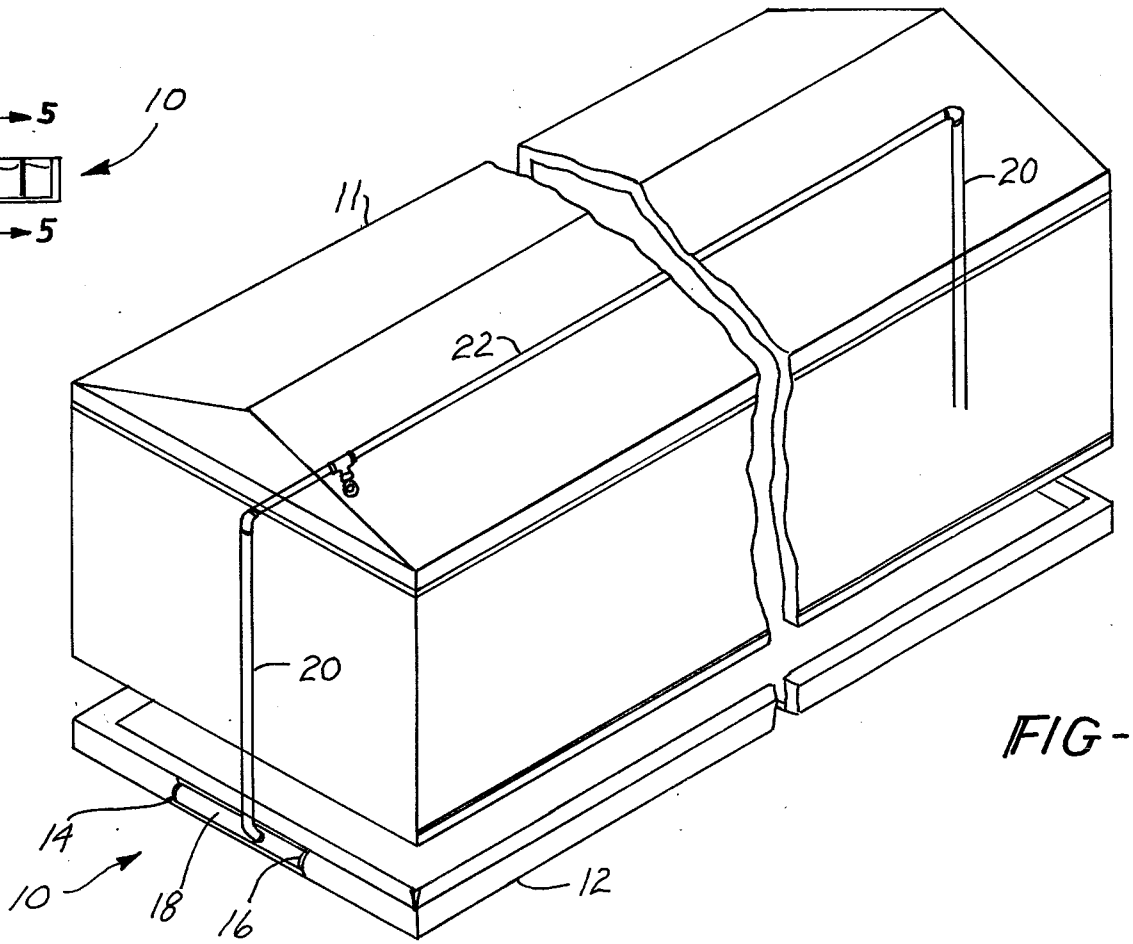
FIG. 1 is a partially exploded, perspective view of a mobile home incorporating the anchoring and fire extinguishing system constructed in accordance with the principles of the present invention.

Referring now to the drawings and, in particular, to FIG. 1 wherein there is illustrated one example of the present invention in the form of an anchoring and fire extinguishing system 10 which supports a conventional mobile unit, such as a mobile home 11, in a desired location. The system 10 functions to extinguish any fire that may occur within the interior of the mobile home 11, all of which will be described in greater detail hereinafter.

As can be seen throughout the several figures, the anchoring and fire extinguishing system 10 comprises an expansible container 12 which is fabricated from a tough, resilient, flexible material, such as reinforced fiberglass, reinforced nylon or reinforced rubber. The container 12 is filled with water 13 having a weight which is approximately equal to the weight of the object (mobile home 11) which is desired to be positioned on the system 10. The container 12 should be of sufficient strength to withstand an internal pressure of at least 50 psi. It should, however, additionally be of sufficient strength and thickness to withstand accidental contact so as not to easily puncture. It should also be noted that a freeze-resistant solution, such as an anti-freeze additive, may be added to the water in those areas wherein the climate necessitates such a procedure. It should be further noted that other forms of fire extinguishing agents may be employed in lieu of water; however, water is the preferred agent to be used in the system 10. The opposite longitudinal ends of the container 12 have necked down portions 14 and 16 which, respectively, communicate with a plastic conduit 18. The necked down portions 14 and 16 are securely attached to the plastic conduit 18 by any suitable fastening means. The conduit 18 is, in turn, connected to upright conduits 20 which extend upwardly toward the ceiling portion of the mobile home 11 for communication with horizontal conduit 22. It can thus be seen that the opposite ends of the container 12 are in fluid communication with each other via the conduits 20 and 22. The conduit 22 is provided with a plurality of temperature sensitive sprinkling heads 24 which are strategically located along the length of the conduit 22. As will be described hereinafter, the sprinkling heads 24 are of a conventional design and are operable to open communication from the conduit 22 when the temperature near the sprinkling heads 24 is such as to activate the same. To this extent, the system 10 is conventional in that the temperature actuated sprinkling heads 24 are operable to communicate water from the conduit 22 onto any fire within the mobile home 11 so as to extinguish the fire.

Figure 2:
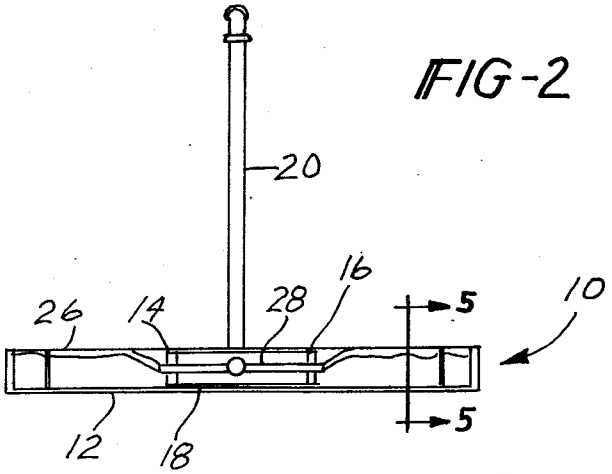
FIG. 2 is a side elevational view of the anchoring and fire extinguishing system illustrated in FIG. 1 with the mobile home removed for clarity.
Figure 5:
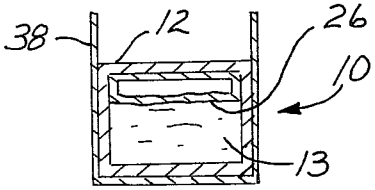
FIG. 5 is a fragmentary, cross-sectional view of the anchoring and fire extinguishing system taken along Line 5—5 of FIG. 2.
Figure 4:
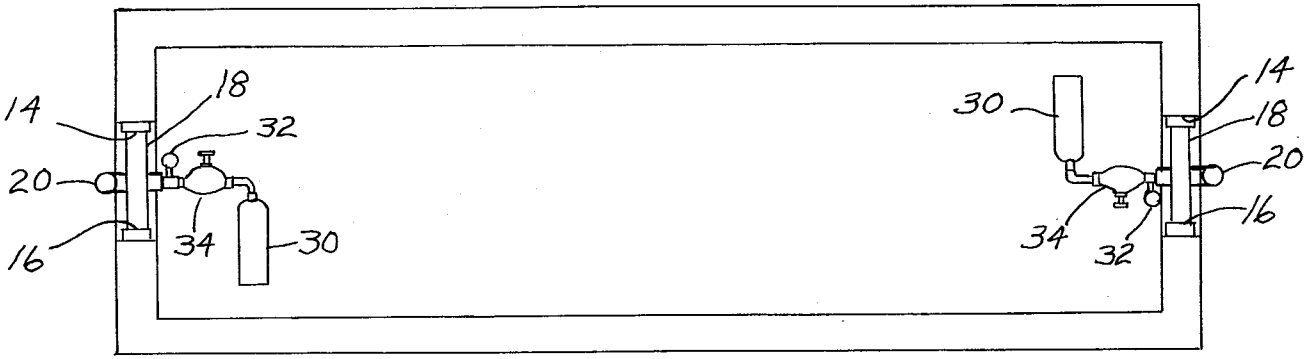
FIG. 4 is a longitudinal, partially sectioned view of the anchoring and fire extinguishing system taken along Line 4—4 of FIG. 3.
Figure 3:
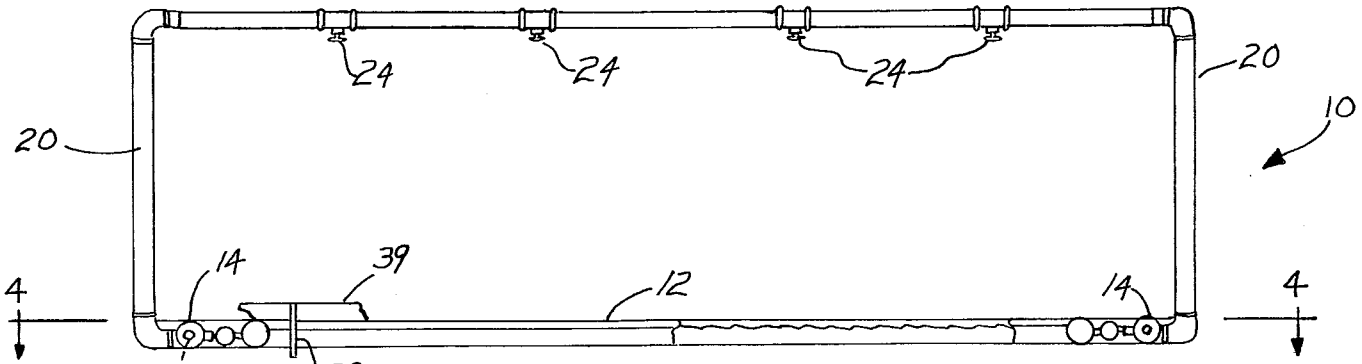
FIG. 3 is a front elevational view of the anchoring and fire extinguishing system illustrated in FIG. 1 of the drawings.

The water within the container 12 is pressurized by an internal bladder 26 (FIGS. 2 and 5) which is disposed throughout the full length of the container 22. The bladder 26 is preferably fabricated from an expansible, tough, resilient, flexible material, such as reinforced fiberglass, nylon or rubber, and is adapted to expand to fill the entire interior of the container 12 so as to exert a constant pressure on the water therewithin. The bladder 26 communicates through the opposite ends 14 and 16 of the container 12 through a smaller conduit 28 that extends through the center of the plastic conduit 18. The mid-section of the conduit 28 communicates laterally with pressure tanks 30 which are located at the opposite ends of the mobile home 11. Communication between each pressure tank 30 and the reduced diametered conduit 28 is through a pressure gauge 32 and an on-off valve in the form of a pressure regulator 34. The pressure tank 30, which should contain an inert gas, such as carbon dioxide or nitrogen oxide, pressurized to approximately 10,000 psi, will function to communicate the gas to the internal bladder 26 exerting a pressure on the water 13. The pressurized gas, which also may be air, may be adjusted by means of the pressure regulator 34; however, it is preferred that the pressure be maintained at approximately 50 psi minimum such that the pressure of the water 13 within the container 12 is maintained at a minimum of 50 psi, as aforementioned.

It can thus be seen that when a pressurized fluid from the tank 30 is communicated via the pressure regulator 34 and connecting conduits 28 to the internal bladder 26, the pressure of the water in the container 12 will be maintained at a constant pressure, for example, 50 psi, so as to supply the water required for the sprinkling head 24. It should be noted that there is no expenditure of energy or of the fire extinguishing agent unless the system 10 becomes operable because of a fire.

In the event of a fire and the sprinkler 24 being actuated because of a rise in temperature, the water within the container 12, under the force of the pressure exerted by the internal bladder 26, will be communicated through the ends 14 and 16 of the water container 12 through conduit 18 to the conduits 20 and 22 for communication and deployment through the sprinkling head 24 so as to extinguish any fire that may occur. When there is no need for the fire extinguishing aspects of the present system to be employed, the system 10 functions to provide an anchoring or stabilizing means to protect the mobile home 11 from being tipped during severe weather and when moderately high winds could endanger the mobile home 11. To this extent, stabilization is provided by having a plurality of strategically located metal or steel straps 38, which extend under the container 10 and engage a portion of the load bearing members 39 of the mobile home 11. The steel straps 38 may be secured to the load bearing members of the mobile home by any suitable fastening means, such as clamps or the like.

It can thus be seen that the present invention provides an anchoring and fire extinguishing system which requires no external power source and therefore may be operated in remote areas, as the water for the system may be simply trucked in or obtained from a well nearby. It should also be noted that the present system is one which requires very little expense or maintenance for its upkeep and needs only to be refilled in the event it becomes operable to extinguish a fire.

It should also be noted that since applicant's system is fabricated from tough, resilient, flexible and pliable materials, it is readily movable and may be used at different locations, if it is desired to move the mobile home. It should also be noted that because of the simplicity of applicant's design, it may be incorporated in new designs as an integral portion of the mobile home or it may be simply used in conjunction with existing mobile homes which may be easily retrofitted to accommodate applicant's unique and novel anchoring and fire extinguishing system.

It should be understood by those skilled in the art of anchoring and fire extinguishing systems that other forms of applicant's invention may be had, all coming within the spirit of the invention and scope of the appended claims.

What is claimed is as follows:

1. An anchoring and fire extinguishing system for mobile homes and the like, said system comprising:
   - a container filled with water, said container having a peripheral shape and an upper surface generally conforming to the outer peripheral bottom edge of said home so as to receive and support said home on said upper surface in a stationary position;
   - fastening means connecting said container to said home for securing said home to said container;
   - normally closed conduit means for communicating the water in said container to the interior of said home;
   - valve means operable in response to a predetermined level of heat in said mobile home for opening communication through said conduit means so as to deploy said water on said fire;
   - means for pressurizing the water in said container so as to deploy the same through said valve means;
   - an internal bladder located within said container;
   - a pressure tank communicating with said internal bladder; and
   - means for controlling pressure from said pressure tank to said internal bladder so as to expand said internal bladder and exert a constant, predetermined amount of pressure on said water to force said water through said conduit means and said valve means when said valve means is operable to open communication from said conduit means.

2. The anchoring and fire extinguishing system defined in claim 1 wherein said container is filled with water.

3. The anchoring and fire extinguishing system defined in claim 1 wherein said water filled container is fabricated from a tough, resilient, pliable and flexible material.

4. The anchoring and fire extinguishing system defined in claim 2 wherein said water-filled container is fabricated from a tough, resilient, pliable and flexible material.

5. An anchoring and fire extinguishing system for mobile homes and the like, said system comprising:

a container filled with a fire extinguishing agent, said container having a peripheral shape and an upper surface generally conforming to the outer peripheral bottom edge of said home so as to receive and support said home on said container upper surface in a stationary position;

fastening means connecting said container to said home for securing said home to said container;

normally closed conduit means for communicating the agent in said container to the interior of said home;

valve means operable in response to a predetermined level of heat in said mobile home for opening communication through said conduit means so as to deploy said fire extinguishing agent on said fire; and means for pressurizing the fire agent in said container so as to deploy the same through said valve means.

* * * * *